US007412860B1

(12) United States Patent
Field et al.

(10) Patent No.: US 7,412,860 B1
(45) Date of Patent: Aug. 19, 2008

(54) KEY BLANK AND KEY

(75) Inventors: Peter H. Field, Salem, VA (US); Steve Poff, Roanoke, VA (US)

(73) Assignee: Medeco Security Locks, Inc., Salem, VA (US)

( * ) Notice: Subject to any disclaimer, the term of this patent is extended or adjusted under 35 U.S.C. 154(b) by 0 days.

(21) Appl. No.: 11/694,097

(22) Filed: Mar. 30, 2007

(51) Int. Cl.
*E05B 19/06* (2006.01)

(52) U.S. Cl. ..... 70/340; 70/347; 70/406; 70/407; 70/409; 70/420; 70/453

(58) Field of Classification Search ..... 70/405–407, 70/409, 420, 453, 454, 347, 337–343, 493–495; D8/347, 348
See application file for complete search history.

(56) References Cited

U.S. PATENT DOCUMENTS

| | | | | |
|---|---|---|---|---|
| 263,244 | A | | 8/1882 | Taylor |
| 420,174 | A | | 1/1890 | Taylor |
| 567,305 | A | | 9/1896 | Donovan |
| 608,069 | A | | 7/1898 | Noack |
| 1,679,558 | A | | 8/1928 | Best |
| 3,499,302 | A | | 3/1970 | Spain et al. |
| 3,499,304 | A | | 3/1970 | Naujoks |
| 3,722,240 | A | | 3/1973 | Spain et al. |
| 4,103,526 | A | | 8/1978 | Surko |
| 4,168,617 | A | | 9/1979 | Prunbauer |
| 4,356,713 | A | | 11/1982 | Widen |
| 4,368,629 | A | | 1/1983 | Prunbauer |
| 4,393,673 | A | | 7/1983 | Widen |
| 4,416,128 | A | | 11/1983 | Steinbrink |
| 4,635,455 | A | | 1/1987 | Oliver |
| 4,653,298 | A | | 3/1987 | Tietz |
| 4,683,740 | A | | 8/1987 | Errani |
| D325,160 | S | * | 4/1992 | Best et al. ..... D8/347 |
| D327,635 | S | * | 7/1992 | Best et al. ..... D8/347 |
| 5,287,712 | A | * | 2/1994 | Sieg ..... 70/406 |
| 5,289,709 | A | | 3/1994 | Field |
| 5,419,168 | A | | 5/1995 | Field |
| 5,490,405 | A | * | 2/1996 | Ramo et al. ..... 70/366 |
| D368,846 | S | * | 4/1996 | Myers et al. ..... D8/347 |
| 5,570,601 | A | | 11/1996 | Field |
| 5,615,565 | A | | 4/1997 | Field |
| 5,715,717 | A | | 2/1998 | Widen |
| 5,809,816 | A | | 9/1998 | Widen |
| 6,023,954 | A | | 2/2000 | Field |
| 6,145,357 | A | | 11/2000 | Stefanescu |
| 6,477,875 | B2 | | 11/2002 | Field et al. |
| 6,851,292 | B2 | | 2/2005 | Kruhn |
| 6,945,082 | B2 | | 9/2005 | Field et al. |

FOREIGN PATENT DOCUMENTS

| | | | |
|---|---|---|---|
| DE | 2828343 | A1 | 10/1980 |

* cited by examiner

*Primary Examiner*—Llyod A Gall
(74) *Attorney, Agent, or Firm*—Rothwell, Figg, Ernst & Manbeck, PC

(57) ABSTRACT

A key blank or key has a rectangular parallel metal shaped blade which has side edges formed with grooves for cooperating with a complementary shaped keyway; the sides of the blank having a portion grooved for registration, another portion grooved for top-level hierarchical master keying, and two other portions, one on each side of the blade, for further master key variations and different combinations. One of the two further sections being curvilinear and the other rectangular or angular cuts.

14 Claims, 6 Drawing Sheets

KEY BLANK AND KEY

This invention relates to improvements in keys and key blanks, particularly with regard to defining the profiles of keys and key blanks using the shapes of ridges or grooves in a generally flat rectangular key blade profile. The shape of the key blank and key, of course, determines the shape of the keyway in a lock cylinder plug.

BACKGROUND AND PRIOR ART

The lock cylinders art is requiring higher and higher security and there is a need in the art for the development of a shape or profile of a cross section of key and corresponding shape of the keyway in the cylinder plug to accommodate a hierarchical lock providing high security. The shape of the keyway is the first barrier that rejects or filters an unauthorized key in attempt to operate the lock cylinder.

There is only a finite space in a lock cylinder plug that can be occupied by the key and that space must be structured to allow for the maximum number of unique keyway shapes to be able to develop lock systems of adequate size. In large modern lock systems it is usual to arrange the structure of the keyways in a manner so that at least three levels of a hierarchical system can be provided, with one master key blank at the top level of the system, some sub-master key blanks at a medium level and several change key blanks at the lowest level of the hierarchical system. A new key section design must be different from prior key sections so that the key blanks can be controlled by the manufacturer and the end user can benefit from the security offered by the exclusivity of this key control via the key blanks.

Unique key profile shapes provide for additional protection against unauthorized key copying. Most key blanks of the generally flat rectangular key profiles are manufactured with single pass formed milling cutters that shape the side of the key blank. The axis of rotation of the cutter is held parallel to the side of the blade. Keys using an undercut groove profile require additional form cutting on specially designed machines that are usually not available at commercial duplicator operations and thus the blanks are more difficult to copy or counterfeit.

Early in the development of lock cylinders, it became apparent that there were specific parameters that affected the size of the lock cylinder systems that could be developed and that there were many design factors that influenced the wear of the key and the cylinder and thus the longevity of the system. Key blanks were designed with these parameters in mind. Representative examples of the prior art include the following:

In U.S. Pat. No. 0,263,244, Taylor discloses a key blank design that offers an economically simple solution to the problem of having a key that moves too freely in the keyhole. This offers a very minimal keyway shape in the plug and key profile in the blank.

In U.S. Pat. No. 0,420,174, Taylor teaches a unique but limited master keying technique that uses a Y shaped key section in a plug that allows two differently shaped key profiles to contact their own areas of the non rotating tumbler pins.

In U.S. Pat. No. 0,567,305, Donavan discloses a method of expanding the number of key sections, thus increasing the available size of lock systems, by dividing the key blank height into various areas and using consistent warding techniques at these locations to develop hierarchical keyways or key profiles. This increases the system size of pin tumbler cylinders. The bittings of one key can be repeated on a different key blank, configured with a different key profile, and the cylinders into which these individual keys fit can also be operated by a higher level key designed to insert into both of the keyways.

In U.S. Pat. No. 0,608,069, Noack discloses an arrangement of key section warding that provides improved wear on the key and the key contact area on the tip of the locking pins. In addition it provides a narrow cross sectional width under the bitting area, thus making it difficult to manipulate pick tools under the tumbler pins.

In U.S. Pat. No. 3,499,304, M. Noujoks teaches a method of designing key section warding where both faces of the keys are provided with alternating ridges and grooves. It utilizes a master key blank that has all the grooves of the series but not the ridges, while the key blanks of a lower hierarchical level have varying ridges.

In U.S. Pat. Nos. 4,168,617 and 4,368,629, Prunbauer discloses more methods of designing key section warding where the master key will fit into the subordinate keyways but the lower keys will not fit into the master keyways. In one embodiment, the ridges and grooves defining the key section are of a rectangular cross-section shape, and the outwardly projecting variable ridge on the subordinate key extends laterally beyond any of the other variable ridges. The subordinate key is thicker at its further ridge than the master key is at any location. In another embodiment the master key is formed of a zigzag shape, that is with its opposite sides formed of a plurality of planar facets each of which is substantially parallel to a respective planar facet on the other side.

In U.S. Pat. No. 4,416,128, Steinbrink teaches another unique method of designing key sections where the longitudinal grooves on both sides of the key blank are formed with bottom faces that lay substantially along the arc of a circle.

In U.S. Pat. No. 4,653,298, Tietz discloses a method of designing master key section warding that incorporates an invariable or family profile near the bitting area on the blank, and the variations defining the individual key sections are located near the spline or bottom edge of the blank. Additionally there are at least two profile formations that cross a center line in the key blank, one ridge is extending beyond the surface of the blank, and the variations are made with longitudinal grooves having rectangular cross sections.

In U.S. Pat. No. 4,683,740, Errani illustrates a key section design that has a undercut groove shape making it very difficult to manipulate a pick tool in the keyway of the plug. The undercut groove is formed by means of cutters having their rotational axis inclined in relation to the sides of the key blank.

In U.S. Pat. Nos. 5,715,717 and 5,809,816, Widen teaches some very specific methods of designing key sections using a three sided undercut groove located closest to the bottom edge of the key blank and extending inwardly inclined towards the bottom of the key blank, or using an undercut groove with a substantially flat surface which is inclined towards the groove bottom surface.

In U.S. Pat. No. 6,145,357, Stefanescu teaches a method of designing master key section warding that utilizes a key blank with a T-shaped cross sectional area with all the profile ribs having specific curvilinear cross sectional contours, with rounded front and flank portions.

In U.S. Pat. No. 6,851,292, Kruhn discloses a method of designing lock and key warding that incorporates specific perpendicular groove surfaces on one side of the key section, and slanting surfaces on the other side that are positioned in a relationship designed to trap, or limit the motion of a picking tool inserted into the key way.

While the prior art has developed usable key sections, they fail to maximize the area of the plug and do not allow for the development of many large master keying systems.

SUMMARY OF THE INVENTION

This invention provides specific parameters for key section profiles and the corresponding key ways in a cylinder plug that allows for the development of many exclusive and non-interchangeable hierarchical master key systems. In order to accomplish this, the key blade is considered separately for three vertical sections from the bottom edge of the blade up to the bitting surface edge of the blade. Each of the three sections is contoured or formed with specific variations of ridges and grooves that establish the key blank's position within a hierarchical system or systems. The bottom most section has a registry groove for the positioning of any secondary side milling operations used in the manufacture of the blank. This registry groove also allows for exact positioning of the blank in a key cutting or bitting machine. A second vertical section of the blade has at least one undercut longitudinal groove on at least one side of the blade. The location and shape of the undercut groove in the second section determines the primary family of the hierarchical system. The third section of the blade, just below the bitting surface may be divided vertically into two sides. One of these sides has a variation of the key section profile determined by using longitudinal grooves of curved shaped forms that are shifted up and down the side of the blade to create the necessary variations. The position and curved form of the profiles on this side determines the secondary and subgroups in the family of the hierarchical system. On the other side of the third or top most section of the blade, the variations in the key section profiles are determined by using longitudinal grooves having substantially rectangular or straight angular cross sections that vary in depth into the side of the blade. The position and depth of the angular profiles on this third section determine the individual location in the subgroup in the hierarchical system. By using these different but specific warding techniques at defined sections and on different sides of the blade it is possible to develop a structured system to allow the maximum number of new and unique key profile shapes. Additionally, by reversing the warding structure from side to side of the blade within different sections, it is possible to significantly increase the already large number of non-interchangeable key systems available, each providing adequate system size for the demands of modern security cylinder users.

DETAILED DESCRIPTION OF THE PREFERRED EMBODIMENTS

Figure 1:
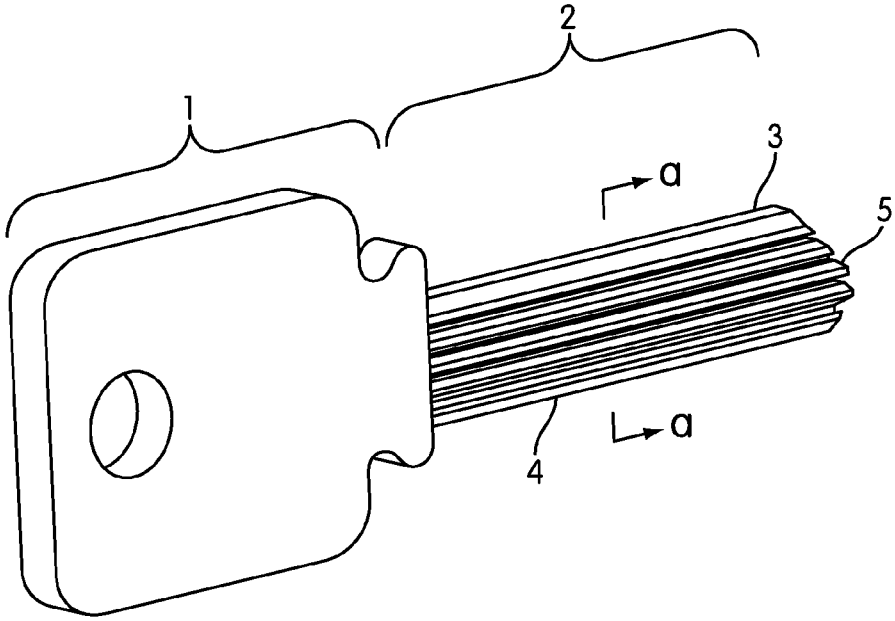
FIG. 1 is a prospective view of a key blank of this invention.

FIG. 1 shows a prospective view of a key blank according to this invention. The key blank has a head or bow 1 for holding and turning the key and a blade 2 for inserting into a keyway of a lock cylinder. The keyway of the lock cylinder has a profile matching the profile of the key blade. The key blade has a top surface 3 into which key bittings (not shown) are cut to position elements such as pin tumblers in a lock cylinder as is well known in the art, see for example the patent to Medeco Security Locks U.S. Pat. No. 5,419,168. The blank has a bottom surface 4 and an end tip 5. The end tip 5 may have a stop or other configuration; see for example U.S. Pat. No. 1,679,558.

Figure 2:
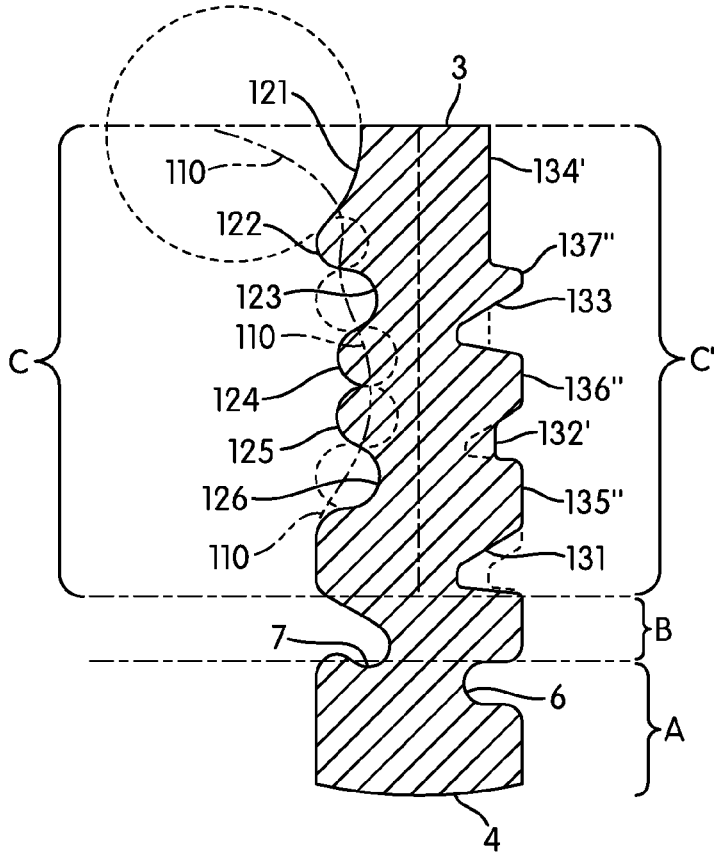
FIG. 2 is a cross-sectional view taken along line a-a of FIG. 1 and enlarged.

The cross section of the key blank in one configuration is shown in FIG. 2. FIG. 2 shows the top of the key blank blade 3 and the bottom of the key blank blade 4 and as shown in phantom lines three different sections. Section A, B, C and C'. As shown, Section A is adjacent to the bottom of the blade, Section C and C' are adjacent to the top of the blade and Section B is in between Section A and Section C and C'.

Section A contains a groove 6 extending the length of the blade for registry purposes. When a key blank is being cut with bittings or machined for other grooves, registry groove 6 is used to provide a location for further operations relative to such groove.

In Section B there is an undercut groove 7 also extending the length of the blade. The undercut groove may be used to provide a first level in the hierarchical scheme for hierarchical master keying.

The area above the undercut groove is divided into the two sides C and C' and the shapes and configurations of the grooves and ridges extending along these two sides are established by distinctly different parameters. The shapes in Section C are determined by a base curvilinear shape 110 on which is overlaid a number of partial circular curves 121, 122, 123, 124, 125 and 126. These curves are all centered along the baseline 110. The curves can project either outwardly as convex ridges or inwardly as concave grooves from the baseline creating either curved longitudinal ridges or curved longitudinal grooves along the side of the blank of Section C and below the bitting area 3. Similar families of curved shapes can be determined by variations in the base curvilinear shape 110, i.e., a different curvilinear shape 110 can function as a center line for the various circular curves. Subgroups of these secondary families may be predetermined by the presence of either curved ridges, e.g., 122, 124, 125, or curved grooves, e.g., 121, 123, 126, and also by moving the base curvilinear shape 110 either up or down the side of the blank in relation to the registry groove 6 in Section A.

The shapes of the side of the key blade in Section C' are determined by providing rectangular sections such as 134' and straight angular shapes such as 131, 132' and 133 and by varying the depths of these shapes into the side of the blank. There are a large number of other locations to provide grooves in Section C' on this side of the blank, for example areas 135", 136" and 137". The size of the grooves and the depths of the grooves that are formed in Section C' on this side of the blank determine the individual position of the key cut from the key blank in the family hierarchical structure.

Figure 3:
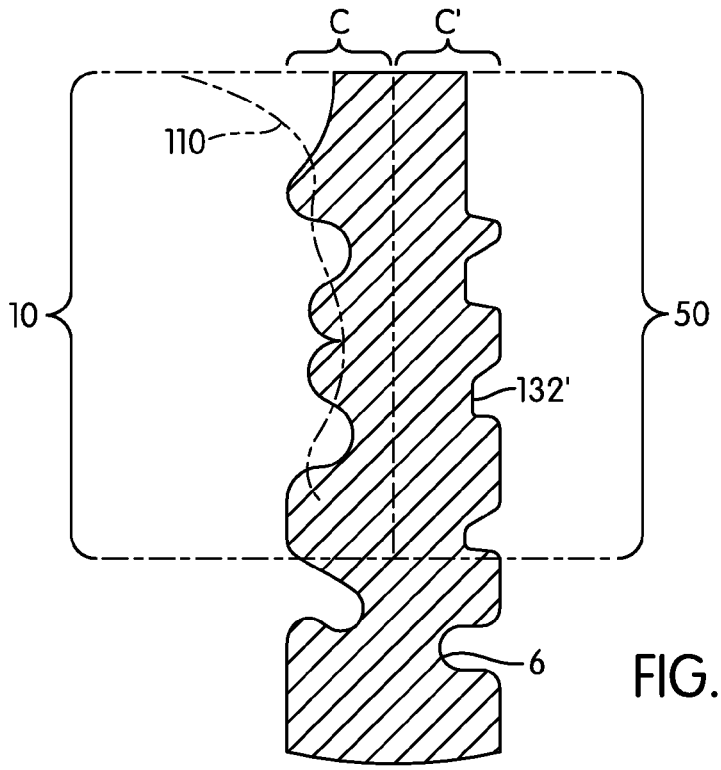
FIGS. 3 through 9 are cross-sectional views of other key configurations on the sides of the key blanks of this invention that illustrate the features of this invention.

FIG. 3 shows the same cross-sectional view of the key blank and illustrates the base curve 110 positioned vertically in relation to registry groove 6 to produce a profile 10 in Section C on one side of the blade. The rectangular and straight angular shapes in Section C' on the other side of the blade has variations, as compared to the key blank of FIG. 2, which define profile 50.

Figure 4:
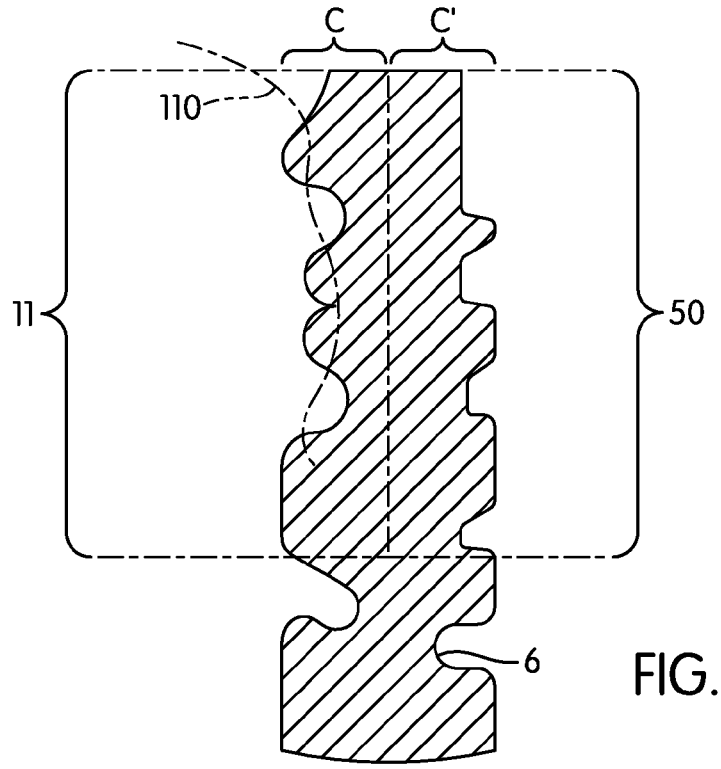

FIG. 4 illustrates another key blank variation in which the base curve 110 is shifted vertically towards the top of the key blank in relation to the registry groove 6 so it is higher than the base curve 110 of FIG. 3, producing a profile indicated at 11. The other side of the key blank in FIG. 4 in Section C' has a profile 50 showing the differences in cutting grooves and producing ridges.

Figure 5:
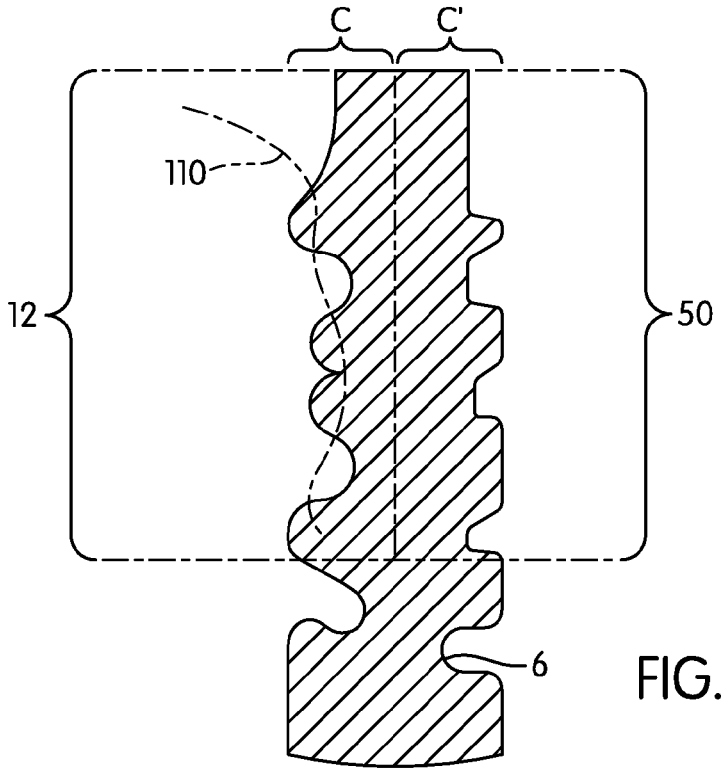

FIG. 5 is a further cross-sectional view of the key blank illustrating the base curve 110 producing profile 12 on Section C of the key blank and profile 50 on the other side in Section C' of the key blank. Profile 12 differs from profile 10 in FIG. 3 and profile 11 in FIG. 4 in that the base curve 110 is shifted vertically down from the top of the key blank relative to the registry groove 6 so it is lower than the base curve 110 of FIG. 3.

Figure 6:
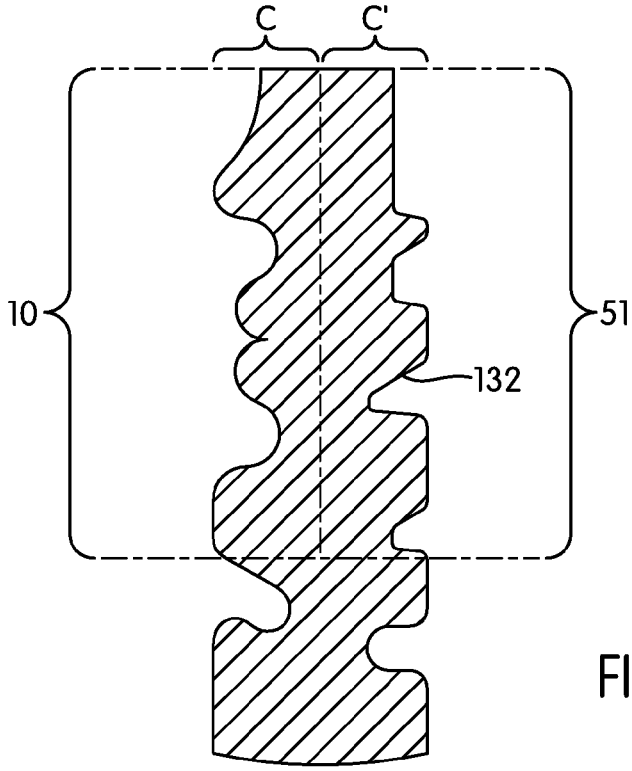

FIG. 6 is a cross-sectional view of the key blank illustrating a profile 10 in Section C and profile 51 in Section C'. Profile 51 differs from profile 50 in that groove 132 projects deeper into the side of the blank than groove 132' of FIG. 3.

Figure 7:
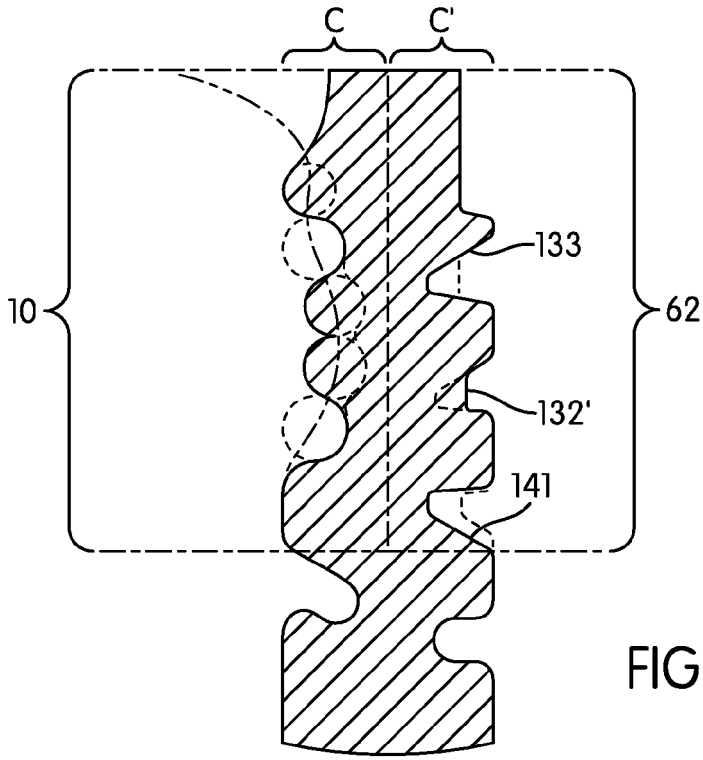

FIG. 7 is a cross-sectional view of a key blank illustrating profile 10 on Section C of the key blank and profile 62 on the other side in Section C'. Profile 62 differs in that groove 141 projects into the side of the blank at a different straight angular shape than groove 131 in FIG. 2.

Figure 8:
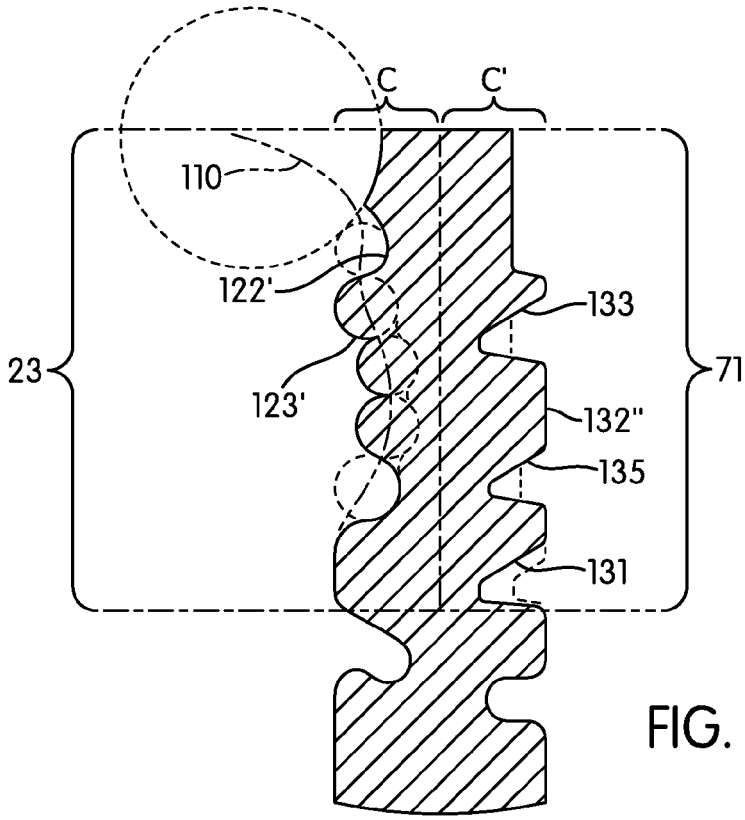

FIG. 8 is a further illustration of a cross-sectional view of a key blank illustrating a profile 23 in one side of the bitting area of the blade in Section C and profile 71 on the other side of the blade in Section C'. In Section C the base curve 110 is the same as shown in FIG. 2, however the curved groove 123 is changed to a curved ridge 123' and the curved ridge 122 is changed to a curved groove 122'. These changes produce a different sub-grouping of the secondary families of the key blank hierarchical structure. In Section C' of the blank in FIG. 8 there is no groove in the area 132" and there is a straight angular groove 135. The straight angular grooves 131, 133 and 135 determine the individual position of the blank in the hierarchical structure.

Figure 9:
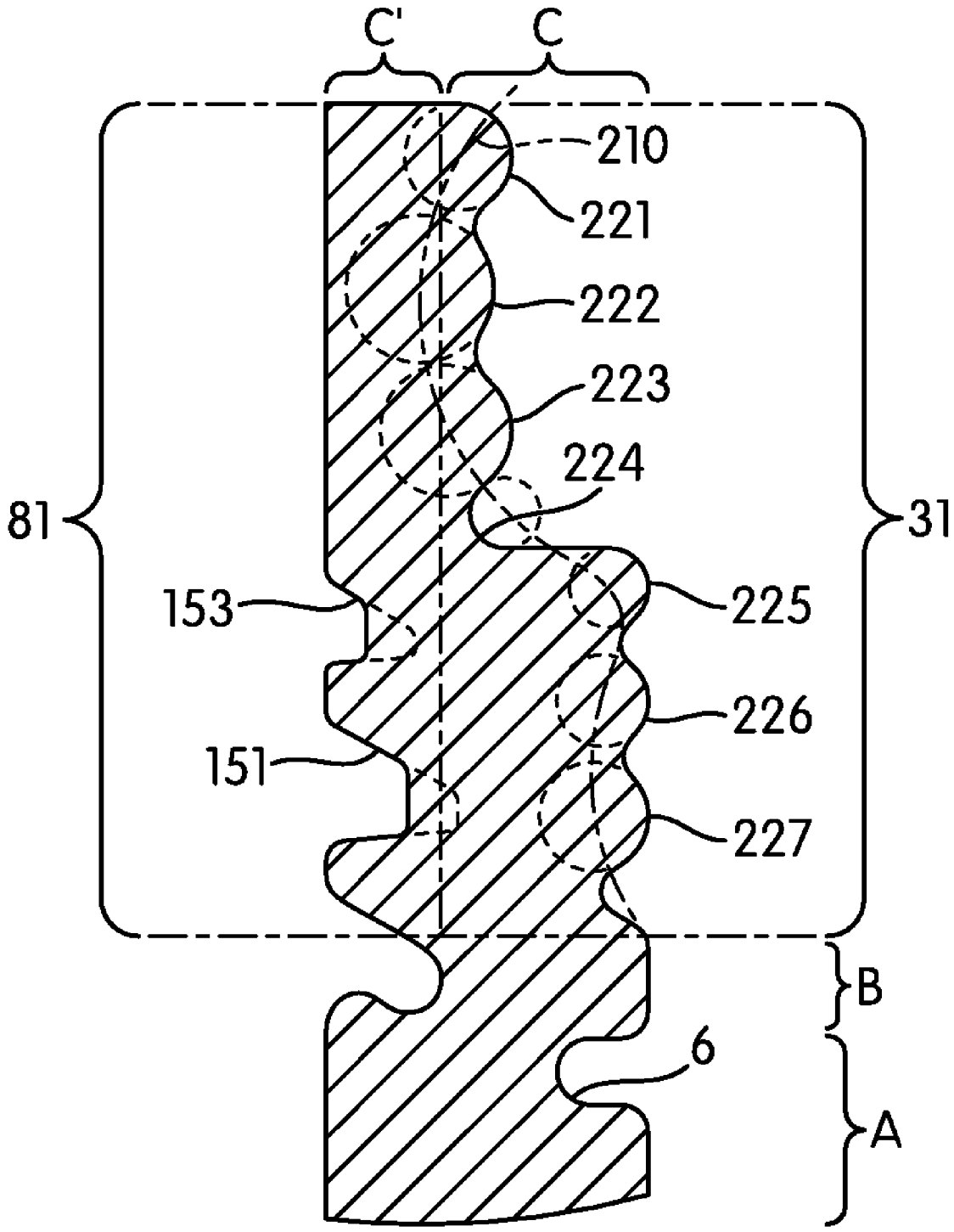

FIG. 9 is a cross-sectional view of another variation of the key blank showing profile 31 in Section C and profile 81 in Section C'. Base curve 210 of profile 31 determines the location of partial circular curves 221-227 that extend as curve grooves 224 or curve ridges 221, 222, 223, 225, 226, 227 along the length of the key blade. Secondary families of the curved shapes are determined by variations in the base curvilinear shape. The subgroups of these secondary families are determined by the presence of either curved ridges or curved grooves and by the position of the base curvilinear shape up or down the side of the blank in relation to the registry groove 6 in Section A. In profile 81 there are only two cut grooves 151 and 153 showing further possible variations.

Figure 10:
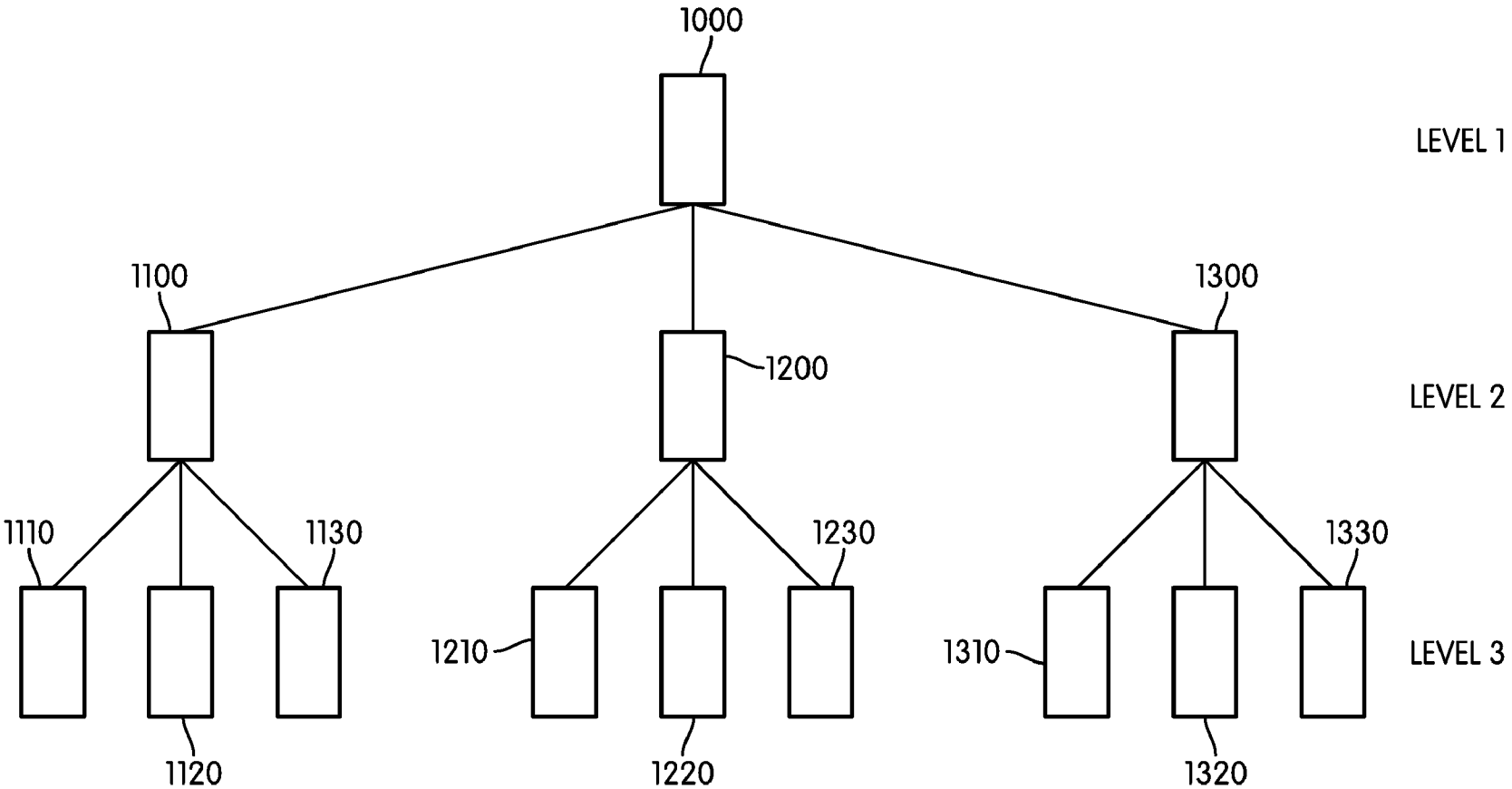
FIG. 10 PRIOR ART
FIG. 10 is an illustrative diagram of a simple three level hierarchical structure of keyways.

FIG. 10 is an illustrative diagram of a simple three-level hierarchical structure of keyways. A key blank that is configured to fit exactly in the top most key section 1000 is structured to also fit in all of the subordinate keyways. A key blank that is configured to fit exactly in one of the secondary level keyways, e.g., 1300, will also fit into all of the subordinate keyways 1310, 1320, 1330 of secondary level keyway 1300, but not into any of the third level keyways 1110, 1120, 1130 of secondary keyway 1100 or 1210, 1220, 1230 of secondary keyway 1200. The keys that will fit in the lowest level of the keyways Level 3 will not fit in any of the higher level keyways. This fit or not fit determination is accomplished not by the bitting at the top of the keys as is typical in prior art (although such could be used to further provide hierarchical structure) but, is provided by the grooves extending along the sides of the key blank as described above.

Further variations and modifications of this invention will be apparent to those with ordinary skill in the art of keys and master keying for mechanical locks.

What is claimed is:

1. A key blank for cutting to form a key to operate within a hierarchical lock system, the key blank having a bow connected to a generally flat-sided blade which has a top edge for cutting key bits therein, a bottom edge, and opposite sides for receiving grooves and ridges which define a cross-sectional shape of the key blade, wherein the blade is divided into three or more sections between the bottom edge and the top edge, and wherein the sections comprise:

a first section having a registry groove for registering the key blade by holding the key blank in a reference position during machining;

a second section having a groove that determines a primary family of a hierarchical lock system; and a third section having different formed configurations on opposite sides of the key blank blade, one side having only curved longitudinal grooves and ridges both defining a curvilinear profile which can be used to determine the secondary and subgroups of the hierarchical lock system, and the other side of the blade in the third section having grooves with only substantially rectangular or straight angular shapes which vary in depth into the side of the blade so that the position and depth of such grooves can determine the individual location in the subgroup of the hierarchical lock system.

2. The key blank as defined in claim 1, wherein the three sections are adjacent to one another, the first section starting at the bottom edge of the key blade and extending upwardly, the second section adjacent the first section and in the middle of the key blade, and the third section between the second section and the top edge of the key blade.

3. Two or more key blanks as defined in claim 1, wherein the grooves and ridges in the third section of one blank are shifted up or down the side of the key blade relative to the position of a similar configuration on another blank to create further variations in key blanks within the hierarchical lock system.

4. Two or more key blanks as defined in claim 1, wherein the substantially rectangular or straight angular shapes formed in the third section of one blank are of different depths and different angles as compared to another blank to create further variations in key blanks within the hierarchical lock system.

5. The key blank as defined in claim 1, wherein the groove formed in the second section is an undercut groove extending the length of the blade.

6. The key blank as defined in claim 1, wherein the grooves and ridges formed on the one side of the key blade have circular profiles that are centered on a curvilinear line corresponding to the curvilinear profile.

7. A method of providing a hierarchical lock system having a plurality of locks operated by different keys, providing different levels of security, the locks having keyways for receiving keys with key blades having cross-section profiles complementary to the section of the keyways, the method comprising; varying the cross-section of the key blades according to the level of the hierarchy to which the blades belong by forming first, second, and third sections from one edge of the blades to an opposite edge of the blades and forming in the first section a registry groove on one side of the blades, in the second section a groove formed in one side of the blades, and in the third section only curvilinear grooves and ridges on one side of the blades and only rectangular or straight angular grooves on the other side of the blades.

8. A key blade with a first edge and a second edge and opposite sides extending between the first and second edges, wherein the blade includes first, second, and third sections between the first and second edges, the blade comprising:

in the first section, a registry groove formed in one side of the blade and extending for at least a portion of the length of the blade and adapted to be engaged by a key forming implement for positioning the blade relative to the key forming implement;

in the second section, a groove formed in one side of the blade and extending for at least a portion of the length of the blade;

in the third section, grooves and ridges formed in one side of the blade and extending the length of the blade, wherein a profile of the grooves and ridges formed in the one side of the blade is defined only by partial circular curves centered on a base curvilinear profile line extending along the one side of the blade and having a predetermined position with respect to the registry groove; and in the third section, grooves formed in the other side of the blade and extending for at least a portion of the length of the blade, wherein the grooves formed in the other side of the blade have only rectangular or straight angular shapes.

9. The key blade of claim 8, wherein the first section extends from the first edge of the blade toward the second edge of the blade, the third section starts at the second edge of the blade and extends toward the first edge of the blade, and the second section is between the first and third sections.

10. The key blade of claim 8, wherein the groove formed in the second section is an undercut groove.

11. A method of forming a key for a hierarchical lock system, the key having a blade with a first edge, a second edge, and opposed sides extending from the first edge to the second edge, the method comprising:

dividing the key blade into at least three sections between the first edge and the second edge;

providing a registry groove in one side of a first section of the blade, the registry groove extending for at least a portion of the length of the blade;

providing a longitudinal groove in one side of a second section of the blade and defining a top-most level in the hierarchical lock system by the shape of the longitudinal groove and the location of the longitudinal groove with respect to the registry groove;

providing in one side of a third section of the blade grooves and ridges having a profile defined only by partial circular curves centered on a base curvilinear profile line extending along the one side of the blade and having a predetermined position with respect to the registry groove; and providing in the other side of the third section grooves having only rectangular or straight angular shapes.

12. The method of claim 11, further comprising varying the shape of the curvilinear profile line to define a second level of the hierarchical lock system below the top-most level.

13. The method of claim 12, further comprising varying the position of the curvilinear profile line with respect to the registry groove to define a third level of the hierarchical lock system below the second level.

14. The method of claim 12, further comprising varying the depth and shape of the grooves formed in the other side of the third section to define an individual position of the key within a hierarchical level.

* * * * *